US006787786B2

(12) United States Patent
Kalas et al.

(10) Patent No.: US 6,787,786 B2
(45) Date of Patent: Sep. 7, 2004

(54) THIN RADIATION SOURCE AND METHOD OF MAKING THE SAME

(75) Inventors: Dan Kalas, Newhall, CA (US); L. Michael Cutrer, Chatsworth, CA (US); Jack Webb, Van Nuys, CA (US)

(73) Assignee: North American Scientific, Inc., Chatsworth, CA (US)

( * ) Notice: Subject to any disclaimer, the term of this patent is extended or adjusted under 35 U.S.C. 154(b) by 183 days.

(21) Appl. No.: 09/880,190

(22) Filed: Jun. 12, 2001

(65) Prior Publication Data

US 2002/0185613 A1 Dec. 12, 2002

(51) Int. Cl.[7] ..... G21G 4/00; G21F 5/02

(52) U.S. Cl. ..... 250/493.1; 250/496.1; 427/5; 118/720

(58) Field of Search ..... 250/493.1, 495.1, 250/496.1; 427/5; 118/720

(56) References Cited

U.S. PATENT DOCUMENTS

| | | | | |
|---|---|---|---|---|
| 1,921,084 A | | 8/1933 | Kipe | |
| 2,575,134 A | | 11/1951 | Schultz et al. | |
| 3,337,735 A | | 8/1967 | Christianson et al. | |
| 4,033,884 A | | 7/1977 | Lorch et al. | |
| 4,676,193 A | * | 6/1987 | Martin | 118/720 |
| 4,882,494 A | | 11/1989 | Rogers et al. | |
| 5,365,076 A | * | 11/1994 | Itakura | 250/582 |
| 6,053,858 A | | 4/2000 | Bueche et al. | |
| 6,086,942 A | | 7/2000 | Carden, Jr. et al. | |

FOREIGN PATENT DOCUMENTS

WO 01/84560 A1 11/2001

* cited by examiner

*Primary Examiner*—John R. Lee
*Assistant Examiner*—Paul M. Gurzo
(74) *Attorney, Agent, or Firm*—Pillsbury Winthrop LLP

(57) ABSTRACT

The present invention relates to radiation sources and a method for producing radiation sources. Embodiments of the present invention are directed to radiation sources that can be used to calibrate nuclear imaging equipment, such as flood sources. According to embodiments of the invention, the radiation source includes a outer housing that contains a substrate upon which a radioactive pattern is deposited. The radioactive deposit may be placed on the surface of the substrate in the form of a deposited solution and may be fixed to the surface of the substrate by, for example, a binding agent and/or a sealing layer. The deposited solution may also include a colorant to visually indicate the activity distribution of the radioactive deposit.

18 Claims, 2 Drawing Sheets

THIN RADIATION SOURCE AND METHOD OF MAKING THE SAME

BACKGROUND

Nuclear imaging equipment, e.g., medical equipment such as gamma cameras, must be regularly calibrated to ensure that images produced thereby accurately reflect the subject being imaged. Generally, this calibration is performed using a radiation source of known uniformity as a reference. These sources are also known as sheet sources or flood sources. These nuclear imaging devices generally detect the emission of radiation, such as gamma rays, from a source. In medical applications, the source may be, for example, an implanted brachytherapy seed, a catheter, a biopsy needle, or an ingested or injected radionuclide solution. The devices may include a collimator for channeling emitted radiation to a detector (e.g., a scintillation crystal), which produces a signal based on the direction, location and intensity of the emitted radiation. By collecting and analyzing these signals, an accurate representation of the spatial distribution, location and intensity of the radiation source can be achieved.

Regular calibration of the nuclear imaging equipment helps to ensure that detector signals are accurately converted into a representation of the source. Errors in imaging can result from misalignment, software failure, or electronic failure of parts within the imaging equipment. When the nuclear imaging camera images a known uniform radiation source, such as a flood source, these equipment failures will appear as non-uniformities in the image of the known uniform source. These non-uniformities can be corrected by proper tuning or calibration of the gamma camera or can be accounted for in the capturing of subsequent non-uniform images.

Accordingly, it is important that radiation sources used for calibration have a relatively uniform or, at least, well-known distribution of activity, both in terms of intensity and spatial distribution. Moreover, because such sources must be frequently handled by personnel, it is important that these sources be sufficiently light and durable and that the radiation exposure of handling personnel be minimized.

Current flood sources are generally made of cast epoxy in which a radioisotope is uniformly distributed and sealed within an outer housing of plastic or metal. Such sources are generally bulky and heavy and are difficult and messy to manufacture. Large molds or leveling tables are required to form the epoxy to the desired shape. Moreover, because radiation is involved, a messy manufacturing process that produces significant amounts of radioactive waste residue is unnecessarily expensive.

After a while, radiation sources used for calibration become depleted. When the sources become depleted they are generally returned to the manufacturer for disposal and replacement with a fresh source. Disposal of a partially depleted source creates additional radioactive waste, which is costly to dispose. Moreover, the sources are bulky and are often shipped in shielded containers that are also large and heavy, resulting in high shipment costs in addition to waste disposal costs.

For these reasons, it is desirable to create a radiation source that is lightweight and/or flexible, that minimizes the mass of radioactive waste when replacement is necessary, and that is simple and clean to manufacture.

DETAILED DESCRIPTION

The present invention relates to radiation sources that may be used, for example, in the calibration of nuclear imaging equipment, such as gamma or other nuclear measuring systems such as SPECT or PET cameras. The present invention is also directed to methods of making and using such radiation sources. Embodiments of the present invention are directed to a radiation source that contains a substrate upon which a radioactive deposit has been deposited. The radioactive deposit may be deposited as a solution and affixed to the surface of the substrate to prevent movement of the radioactive deposit during use of the radiation source. In embodiments of the invention, the substrate may be flexible, so that the form factor of the substrate may be reduced (e.g., by manipulating the shape of the substrate, such as by folding or rolling) for shipment in a smaller shielded container. In embodiments of the source of the present invention, the outer housing containing the substrate may be opened so that a depleted substrate may be replenished or an additional compensatory substrate may be inserted.

Embodiments of the method of making sources according to the present invention may involve forming a radioisotope-containing solution that can be deposited on the surface of the substrate in a selected radioactive deposit. The radioisotope-containing solution may include a radioisotope (or some form thereof) and a solvent. In embodiments of the invention, the solution may also contain a binding agent to affix the radioisotope to the surface of the substrate. In embodiment of the invention, the solution may be deposited on the surface of the substrate using a inkjet-type printhead.

Figure 1:
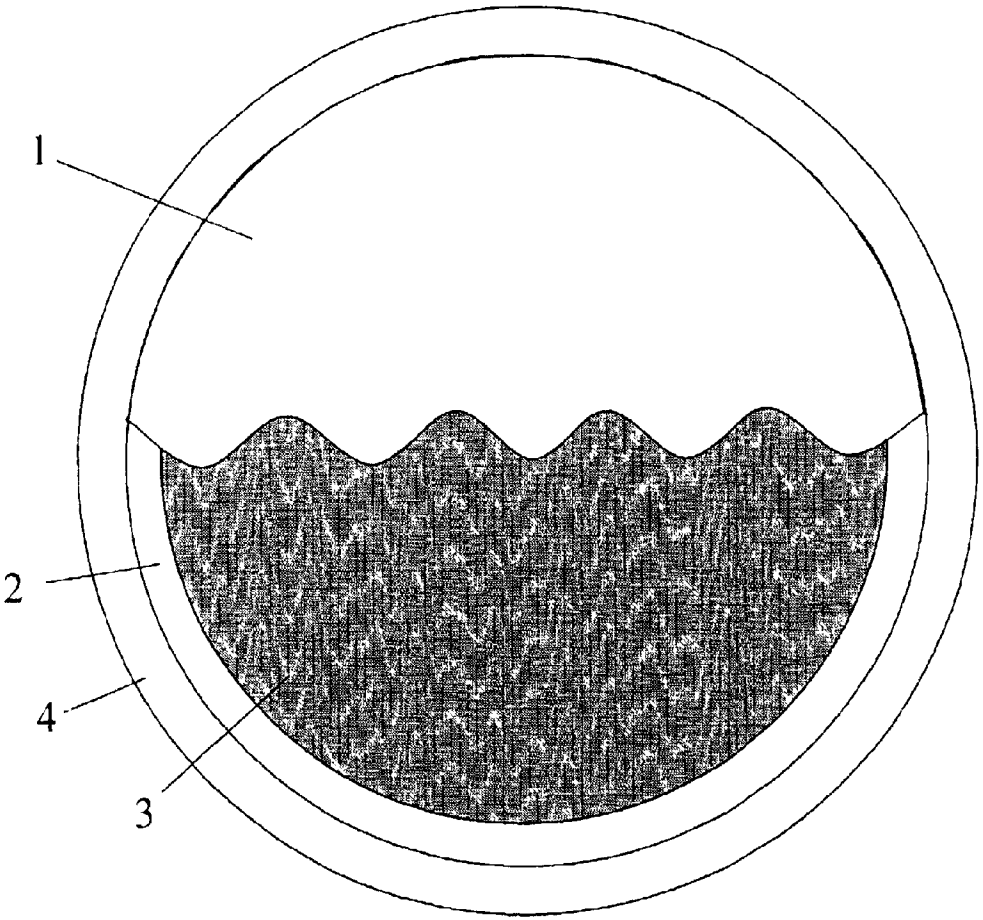
FIG. 1 depicts a flood source embodiment of the present invention.

FIG. 1 illustrates a circular flood source according to an embodiment of the present invention. The source is enclosed in an outer housing 1, a portion of which is shown as removed to reveal the inner substrate 2 and radioactive deposit 3 contained therein. The outer housing 1 may be relatively thin and made of a radiotranslucent material, such as aluminum or plastic. This allows radiation emitted from the substrate 2 to pass through the outer housing 1 for imaging by an imaging device. In embodiments of the invention, the outer housing 1 may be sufficiently rigid to allow fixed mounting of the source during calibration procedures.

The outer housing 1 may contain a substrate 2 having a "front" surface upon which the radioactive deposit 3 may be deposited to achieve a desired activity pattern. In embodiments of the invention, the substrate 2 may be fixed in place in the outer housing 1 by an adhesive, pins, clips, or some other attachment feature, while in other embodiments, the substrate 2 may be fixed in place within the outer housing 1 by the size and/or shape of the outer housing 1 relative to the substrate 2. In some flood source embodiments, the activity pattern may be uniform across the entire surface of the substrate. In other embodiments, the radioactive deposit 3 may be drawn to mimic an implanted radiation emitter (e.g., a brachytherapy seed) or may be drawn to match a specified pattern of spatial distribution and/or activity level (intensity).

In particular embodiments of the invention, the substrate 2 may be a flexible sheet of paper, plastic or some other material. The substrate 2 material may be selected based upon its ability to retain the radioactive deposit 3 in a fixed form. The substrate 2 may be radiopaque, such that radiation is emitted from only the surface of the substrate 2 upon which the radioactive deposit 3 is deposited. The radioactive deposit 3 imprinted on the substrate 2 may include a radioisotope with a relatively long half-life, such as Cobalt-57 or Gold-153.

Although the radioactive deposit 3 is described as being deposited on a "surface" of the substrate 2, it should be noted that this surface need not be exposed. For example, the surface of the substrate 2 upon which the radioactive deposit 3 is deposited may be covered with a sealing layer, such as a layer of plastic or polymer. The sealing layer may be radiotranslucent and may be applied by heating (e.g., lamination), immersion (e.g., in a bath), painting, spraying or a similar suitable process. A sealing layer may be deposited to affix the radioactive deposit to the surface of the substrate 2 and/or to prevent damage to, or removal of, the radioactive deposit 3 or substrate 2.

In an embodiment of the invention, the radioactive deposit 3 may be deposited on the surface of the substrate 2 in the form of a solution (the "deposited solution"). The deposited solution may contain dissolved radioisotope, a solvent and a binding agent. The solvent may be an inorganic solvent (e.g., water) or an organic solvent, (e.g., isopropyl or other alcohols, oils, ketones, esters, or glycols), and the solution may created by dissolving a salt or other compound formed from the radioisotope in the solvent. In an alternative embodiment, the radioisotope may be adsorbed or chemisorbed to a particulate carrier that is evenly dispersed throughout the solution. In alternative embodiments of the invention, the deposited solution may contain a radioisotope precursor that is rendered a radioisotope by neutron bombardment after deposition on the substrate 2. The solvent may evaporate after the deposited solution has been deposited on the surface of the substrate 2, leaving the radioisotope and the remaining ingredients in the deposited solution to form the radioactive deposit 3.

In embodiments of the invention, the deposited solution may also contain a binding agent, such as an organic resin (e.g., acrylics, styrenes, polyesters, polyamides, polyvinyl acetate copolymers, polyketones, phenolics, polyvinylbutyrals, polyvinylpyrrolidones, and maleic anhydride copolymers) or an inorganic binding agent (e.g., sodium silicate). Such binding agents may be used to affix the radioactive deposit 3 to the surface of the substrate 2 and may be chosen based on the characteristics of the substrate 2 and the characteristics of other elements in the deposited solution. For example, the binding agent may be chosen based upon the effects of a radioisotope's activity on its ability to bind to the surface of the substrate 2 or its viscosity during the deposition process.

In further embodiments of the invention, the deposited solution may include a colorant, such as, a dye or pigment. The color of the colorant may correspond to the radioisotope or radioisotope precursor in the deposited solution. Moreover, as described in greater detail with respect to FIG. 2, in the radioactive deposit 3 as deposited, the colorant may serve as a visual indicator of the activity level of various portions of the radioactive deposit 3 or of the radioactive deposit 3 as a whole. In such embodiments, the accuracy of the deposition process in creating a uniform or specified radioactive deposit 3 may be visually verified during the manufacturing process by inspecting the color pattern created by the colorant.

The outer housing 1 may include a border 4. The border 4 may be radiopaque so as to minimize radiation emitted into the hands of personnel maneuvering the source during calibration procedures without substantially changing the radioactive deposit of the source as seen by the imaging device. Although not shown in the pictured embodiment, the border may include handles or other features that make handling of the source by personnel more convenient. Furthermore, the back surface of the outer housing 1 or the substrate 2 may be radiopaque to further minimize radiation exposure to handling personnel.

Figure 2:
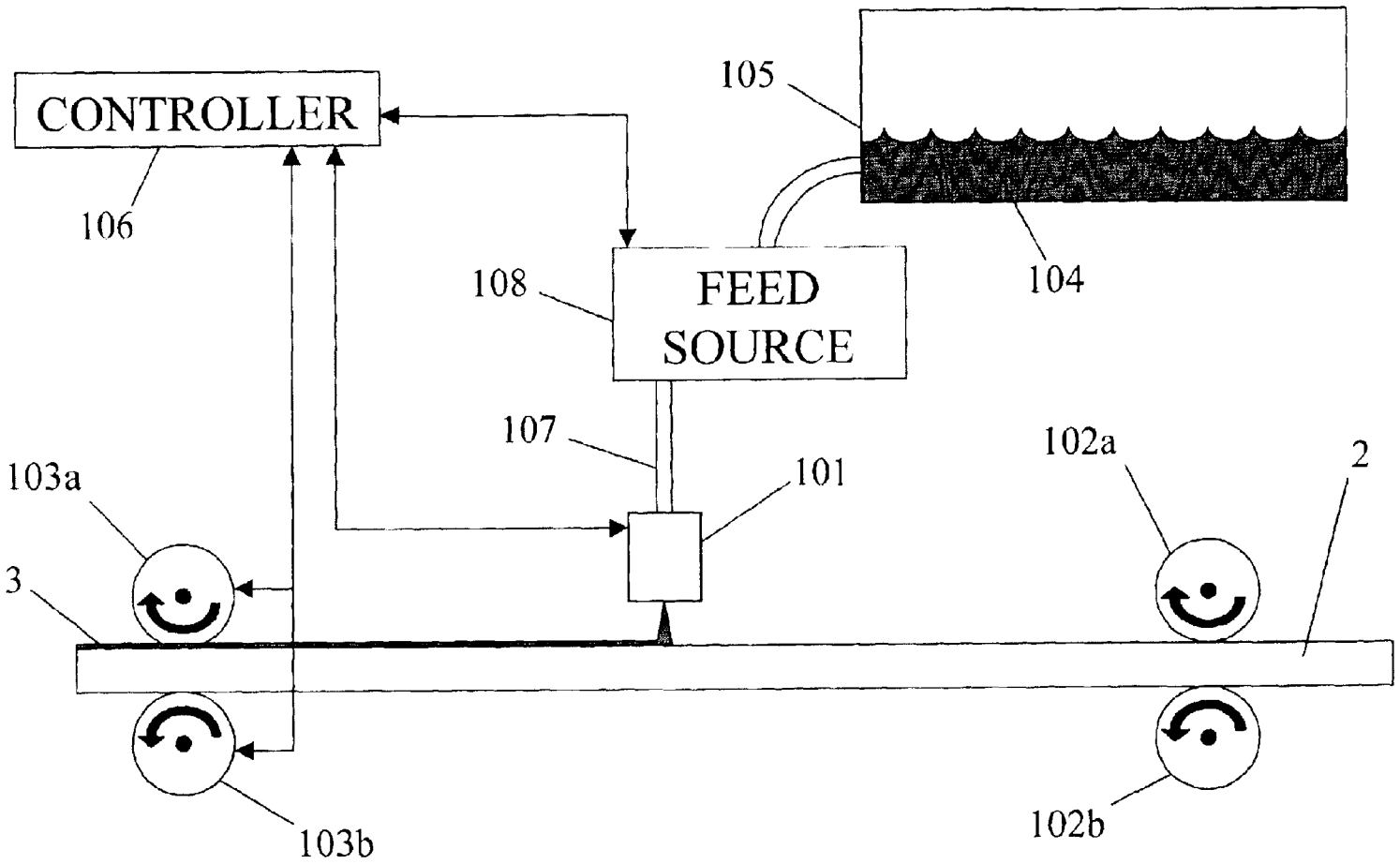
FIG. 2 illustrates a system that may be used to make radiation sources according to embodiments of the present invention.

FIG. 2 illustrates a system that may be used to deposit the radioactive deposit 3 on the surface of the substrate 2 according to an embodiment of the present invention. The blank substrate 2 may be passed in front of a liquid deposition head 101. In embodiments of the invention, the liquid deposition head 101 may be an inkjet-type printhead as can commonly be found in the InkJet or DesignJet lines of inkjet printers available from Hewlett-Packard Company of Palo Alto, Calif. or the Stylus line of inkjet printers available from Seiko Epson Corporation of Japan. In particular embodiments, a large-format inkjet-type printer may be used to accommodate a large substrate 2.

The blank substrate 2 may be positioned relative to the liquid deposition head so that the deposited solution may be placed on different portions of the front surface of the substrate 2. In the embodiment shown in FIG. 2, this may be achieved by rotating rollers 102*a* and 102*b* and 103*a* and 103*b* so as to move the substrate 2 while the position of the liquid deposition head 101 remains fixed. One or more of the rollers 102*a* and 102*b* and 103*a* and 103*b* may be driven by a motor. In the embodiment shown in FIG. 2, the rollers 102*a* and 102*b* and 103*a* and 103*b* are paired as pinch rollers. Such an embodiment may be particularly suitable where the substrate 2 is in the form of a cut sheet.

In alternative embodiments, different roller configurations may be used to move the substrate 2. For example, in embodiments of the invention in which the substrate 2 is a continuous web, unpaired rollers may be used and one surface of the substrate 2 (e.g., the back surface) may be held in tension against the surface of the rollers. The continuous web of substrate 2 may be cut into individual sheets of substrate 2 after the radioactive deposit 3 has been deposited on the front surface.

In other embodiments of the invention, the substrate 2 may be moved using different feeding mechanisms, such as a vacuum belt, air bearing or the like. These feeding mechanisms may be chosen to minimize contact with the front surface of the substrate before the radioactive deposit 3 has been affixed thereon. Alternatively, the liquid deposition head 101 may be moved relative to a fixed-position substrate. In such an embodiment, the liquid deposition head 101 may be mounted on a carriage and the carriage may be moved in the x-, y- and/or z-axes using drive screws.

As generally described above, the radioactive deposit 3 may be created by placing the deposited solution 104 on the front surface of the substrate 2. A controller 106 may communicate with the liquid deposition head 101 to control the placement of the deposited solution 104 on the front surface of the substrate 2. Control signals from the controller 106 to the liquid deposition head 101 may control the rate at which the deposited solution 104 is released from the liquid deposition head 101. Moreover, in embodiments in which the liquid deposition head 101 includes multiple openings, nozzles or jets (hereinafter commonly referred to as "openings") through which the deposited solution 104 may be released, the control signals from the controller 106 may be used to selectively open and close or activate and deactivate these openings.

The deposited solution 104 may be stored in a container 105 and fed to the liquid deposition head 101 through a feed source 108 and a feed line 107 (or multiple feed lines in embodiments in which the liquid deposition head 101 has multiple openings). In embodiments of the invention, the feed source 108 may be a pump or other device suitable for causing forced flow of the deposited liquid 104. The characteristics of the feed source may be selected based on the viscosity of the deposited liquid, the size of the feed line 108 and other factors. The feed source 108 may receive signals from the controller 106 so as to control the flow of deposited solution 104 to the liquid deposition head 101. The received control signals may regulate the differential pressure applied by the feed source 108 to generate forced flow or may direct flow to specified feed lines in embodiments in which multiple feed lines are used. In other embodiments, the feed source 108 may be a valve and differential pressure to force flow of the deposited solution to the feed line 107 may be created by a sufficient gravity head.

In alternative embodiments, the dissolved radioisotope (i.e., radioisotope and solvent solution) may be stored in the container 105 and mix in additional ingredients of the deposited solution 104 shortly before deposition of the radioactive deposit 3. This may be desirable in embodiments in which the fluid properties of other ingredients of the deposited solution 104 (e.g., binding agent, colorant) are adversely affected by the activity of the radioisotope. In such embodiments, mixing may be done within the liquid deposition head 101 or in a separate mixing tank positioned between the feed source 108 and the liquid deposition head 101.

In embodiments of the invention in which the liquid deposition head 101 is moved, the feed line 107 may be flexible and/or extendible so as to permit a suitable range of motion for the liquid deposition head 101. The size of the feed line may be selected based upon the viscosity of the deposited solution 104 so as to ensure free flow of the deposited solution 104 to the liquid deposition head 101. The connections between the feed line 107 and the feed source 108 and between the feed line 107 and the liquid deposition head may be made liquid-tight. Particularly in embodiments in which the deposited solution contains active radioisotope, liquid-tight connections may minimize the amount of active deposited solution leaking during the deposition process so as to lessen radiation exposure to manufacturing personnel and minimize radioactive waste produced during the manufacturing process.

In embodiments in which the deposited solution 104 contains active radioisotope, the container 105 may be shielded so as to minimize the radiation exposure of other components in the system. Where the deposited solution 104 contains a solvent or other ingredient that is susceptible to evaporation, the container 105 may be sealed to prevent such evaporation. In particular embodiments of the invention, the container may be similar to a standard inkjet-type ink cartridge.

In embodiments of the invention, the deposition process may be done in layers, with each layer being associated with a uniform activity density and additional layers being deposited on portions of the radioactive deposit 3 corresponding to higher levels of activity. This process may resemble the hue-saturation-value process for inkjet-type printing. In fact, in embodiments in which the deposited solution 104 includes a colorant, the resulting radioactive deposit 3 may resemble grayscale or color printing carried out using a hue-saturation-value process. Alternatively, the radioactive deposit 3 may be broken down into a number of areas ("pixels") and the number of drops of deposited solution 104 placed within a pixel of the radioactive deposit 3 may determine the activity level of the pixel. In embodiments of the invention in which each pixel is relatively small, the resulting radioactive deposit may appear consistent as a result.

In embodiments of the invention involving thermal "printing," the deposited solution 104 may be propelled out of the liquid deposition head 101 by heating a resistive element within the liquid deposition head 101 to create a bubble in the chamber filled with the deposited solution 104. As the resistive element is heated, the bubble expands, pushing the deposited solution out of the liquid deposition head 101 toward the surface of the substrate 2. In alternative embodiments involving vibrational "printing," deposited solution 104 may be expelled from the liquid deposition head 101 by the vibration of a transducer. The transducer may have piezo-electric properties (i.e., may expand or contract when electrical current is passed through it), and vibration may be induced by charging or removing charge from the transducer.

While the description above focuses on the use of an inkjet-type printing mechanism, a person of ordinary skill in the art will recognize that other types of printing devices may be used to place the radioactive deposit 3 on the surface of the substrate 2. For example, a variety of impact or non-impact printers (e.g., solid ink printers, dot matrix printers, character printers, thermal wax printers), plotters, airbrushes or the like may be used.

Returning to FIG. 1, in embodiments of the invention, the outer housing 1 may be opened so that the substrate 2 with the deposited radioisotope 3 may be removed. In such embodiments, the outer housing 1 may include a fastener. Furthermore, in such embodiments, the outer housing 1 may be hinged or otherwise constructed so that the parts of the outer housing 1 remain in contact at a point(s) when the outer housing 1 is opened. This may prevent misalignment of the parts of the outer housing 1 when the outer housing 1 is closed. The fastener may be a lock, a snap or a similar latching mechanism that may be selectively unfastened and may require a key, dial combination or other access device for opening. Alternatively, the fastener may be a screw, pin or other mechanism that must be removed for the outer housing to be opened.

In some embodiments, the outer housing may be opened by personnel using the source or other personnel at the customer's site, so that depleted substrates can be shipped back to the manufacturer for replenishment. Where the substrate 2 is flexible, the using personnel may change the shape of the substrate 2 to reduce its form factor (e.g., by manipulating the substrate by rolling it into a cylindrical shape or folding it) and the protective shipping container may be smaller in size than the expanded substrate 2. Because the shipping container must be fully-shielded and because shielding materials are generally heavy, shipping the depleted substrates 2 back to the manufacturer (and shipping replenished substrates to the customer) without the outer housing 1 and with smaller shipping containers may significantly reduce shipping expenses.

In embodiments with a outer housing 1 that may be opened, the entire source, when depleted, may be returned to the manufacturer. The manufacturer may open the outer housing 1, measure the remaining activity level of the depleted substrate 2 ("the pattern of depleted activity") and create a second substrate with an activity level matching the difference between that of a fresh substrate and the depleted substrate 2. The manufacturer may then place the second substrate in the outer housing 1 and close the outer housing 1 before sending it back to the customer as a fresh source. In such a system, the manufacturer may note that the depleted substrate 2 exhibits a pattern of depleted activity and may cause the second substrate to be imprinted with a compensatory pattern of deposited radioisotope so that the combined activity pattern of the depleted substrate 2 and the second substrate substantially matches the activity pattern of a fresh substrate. Alternatively, the compensatory pattern of deposited radioisotope may be deposited over the depleted radioactive deposit 3 on the first (depleted) substrate 1. The pattern of depleted activity may be even or uneven depending, in part, upon whether the radioactive deposit 3 initially deposited on the substrate was uniform or not, whether one or more types of radioisotopes were combined to form the radioactive deposit 3, etc.

While the description above refers to particular embodiments of the present invention, it should be readily apparent to people of ordinary skill in the art that a number of modifications may be made without departing from the spirit thereof. The accompanying claims are intended to cover such modifications as would fall within the true spirit and scope of the invention. The presently disclosed embodiments are, therefore, to be considered in all respects as illustrative and not restrictive, the scope of the invention being indicated by the appended claims rather than the foregoing description. All changes that come within the meaning of and range of equivalency of the claims are intended to be embraced therein.

What is claimed is:

1. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope wherein said substrate is flexible.

2. The radiation source according to claim 1, wherein said substrate is made of one of paper and plastic.

3. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said substrate is flexible, said substrate has a first form factor when contained within said outer housing, and said substrate is manipulable to have a second form factor smaller than said first form factor when said substrate is removed from said outer housing.

4. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein at least a portion of said radioactive deposit has at least two layers.

5. The radiation source according to claim 4, wherein an activity density of each of said at least two layers is the same.

6. A radiation source comprising;

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said substrate is radiopaque.

7. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said radioactive deposit includes a colorant.

8. The radiation source according to claim 7, wherein a color of a portion of said radioactive deposit corresponds to an activity level of said portion of said radioactive deposit.

9. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said radioactive deposit includes a binding agent for fixedly depositing said radioactive deposit on said front surface.

10. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said radioactive deposit is fixedly deposited upon said front surface by covering said radioactive deposit and said front surface with a sealing layer.

11. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, further including a second substrate with a second radioactive deposit deposited thereon, said second substrate being contained within said outer housing.

12. The radiation source according the claim 11, wherein the combination of said radioactive deposit and said second radioactive deposit produces a desired radioactive deposit.

13. A radiation source comprising:

an outer housing having a fastener, said outer housing configured to be opened;

a substrate removably contained within said outer housing, said substrate having a front surface; and a radioactive deposit fixedly deposited upon said front surface within said outer housing, said radioactive deposit having a radioisotope, wherein said radioactive deposit has a substantially uniform activity distribution.

14. A radiation source for calibration of nuclear imaging equipment, said radiation source comprising:

an outer housing having a fastener, said outer housing configured to be opened;

a flexible substrate removably contained within said outer housing, said substrate having a front surface; and a radioactive deposit fixedly deposited upon said front surface within said outer housing, said radioactive deposit having a radioisotope, a binding agent, and a colorant, wherein at least a portion of said radioactive deposit has at least two layers, each layer having substantially the same activity density, and a color of a second portion of said radioactive deposit indicates the activity level of said portion of said radioactive deposit.

15. A radiation source for calibration of nuclear imaging equipment, said radiation source comprising:

an outer housing having a fastener, said outer housing configured to be opened;

a flexible substrate removably contained within said outer housing, said substrate having a front surface;

a radioactive deposit fixedly deposited upon said front surface within said outer housing, said radioactive deposit having a radioisotope, and a colorant; and a sealing layer covering said radioactive deposit and said front surface of said substrate, wherein at least a portion of said radioactive deposit has at least two layers, each layer having substantially the same activity density, and a color of a second portion of said radioactive deposit indicates an activity level of said second portion of said radioactive deposit.

16. A nuclear imaging system, comprising:

a piece of nuclear imaging equipment to be calibrated; and a radiation flood source to calibrate the piece of nuclear imaging equipment including, an outer housing having a fastener, said outer housing configured to be opened, a substrate removably contained within said outer housing, said substrate having a front surface; and a radioactive deposit fixedly deposited upon said front surface within said outer housing, said radioactive deposit having a radioisotope, further including a second substrate with a second radioactive deposit deposited thereon, said second substrate being contained within said outer housing.

17. A nuclear imaging system, comprising:

a piece of nuclear imaging equipment to be calibrated; and a radiation flood source to calibrate the piece of nuclear imaging equipment including, an outer housing having a fastener, said outer housing configured to be opened, a substrate removably contained within said outer housing, said substrate having a front surface; and a radioactive deposit fixedly deposited upon said front surface within said outer housing, said radioactive deposit having a radioisotope, wherein the combination of said radioactive deposit and said second radioactive deposit produces a desired radioactive result.

18. A radiation source for calibration of nuclear imaging equipment, said radiation source comprising:

an outer housing having a fastener, said outer housing configured to be opened;

a flexible substrate removably contained within said outer housing, said substrate having a front surface; and a radioactive deposit fixedly deposited upon said front surface within said outer housing, said radioactive deposit having a radioisotope, a binding agent, and a colorant, wherein said substrate has a first form factor when contained within said outer housing, and said substrate is manipulable to have a second form factor smaller than said first form factor when said substrate is removed from said outer housing;

at least a portion of said radioactive deposit has at least two layers, each layer having substantially the same activity density, and the color of a portion of said radioactive deposit indicates the activity level of said portion of said radioactive deposit.

* * * * *